US006772439B1

(12) United States Patent
McMullen, Jr.

(10) Patent No.: US 6,772,439 B1
(45) Date of Patent: Aug. 10, 2004

(54) RETRACTABLE SPORT PADDING SYSTEM

(76) Inventor: James J. McMullen, Jr., 717 Ramona Pl., Del Mar, CA (US) 92014

( * ) Notice: Subject to any disclaimer, the term of this patent is extended or adjusted under 35 U.S.C. 154(b) by 0 days.

(21) Appl. No.: 10/455,280

(22) Filed: Jun. 5, 2003

(51) Int. Cl.[7] ..... A41D 13/00
(52) U.S. Cl. ..... 2/46; 2/455
(58) Field of Search ..... 2/69, 46, 455, 2/227, 79, 92, 44, 228, 238, 51, 456, 267, 208, 66, 22, 91, 465–467, 908, DIG. 3

(56) References Cited

U.S. PATENT DOCUMENTS

| | | | |
|---|---|---|---|
| 2,446,006 | A | 7/1948 | Hendricks |
| 4,151,613 | A | 5/1979 | Rhee |
| 4,700,407 | A | 10/1987 | Mattila |
| 4,894,867 | A | 1/1990 | Ceravolo et al. |
| 4,923,247 | A | 5/1990 | Malmstrom |
| 5,003,634 | A | 4/1991 | Brinkman |
| 5,241,706 | A | 9/1993 | Netz |
| 5,539,926 | A | 7/1996 | Mantos |
| 5,572,737 | A | 11/1996 | Valice |
| 5,619,747 | A | 4/1997 | Boisclair et al. |
| 5,649,328 | A | 7/1997 | Martin |
| 5,652,957 | A | 8/1997 | Willford et al. |
| 5,727,260 | A | 3/1998 | Torch et al. |
| 6,029,281 | A | 2/2000 | Battley |
| 6,175,959 | B1 | 1/2001 | Somers |

*Primary Examiner*—Tejash Patel
(74) *Attorney, Agent, or Firm*—Marc E. Hankin

(57) ABSTRACT

The invention relates to a retractable sports padding that is easily enabled, discretely stowed, can retain personal items in a water resistant environment, and protect the user's lower back and spine, hips, and buttocks region. The invention may include a waist pack with a sleeve, plurality of chambers, an inflatable air bladder with air hose and pump, hip guards, back brace and surfaces to enable sliding. The exterior features, overall look and size are similar to that of a typical waist pack when the air bladder and sleeve are deflated and stowed. The invention, besides being used for wet and dry sports applications, may also be used for many other activities, some of which include working environments.

31 Claims, 5 Drawing Sheets

RETRACTABLE SPORT PADDING SYSTEM

BACKGROUND

The invention relates to personal protective equipment worn over clothes that can be stowed in an integral waist pack with retractable padding and support for use during physical activities where effective padding of the buttocks, lower back and spine, coccyx, hips, and thigh region is desirable.

Active sports such as in-line skating, snow boarding, and off-road bicycling have become increasingly popular. As these and other sports increase in popularity, there is likewise an increasing need for protective equipment to prevent injury due to falls. When repeated falls on the buttocks area are expected, significant amounts of padding have been implicated to assist in minimizing flare-ups and aggravations of musculo-skeletal disorders (such as soreness and bruising) as well as the minor neurological problems which may be associated with participating in snowboarding, skateboarding, skating, bicycling, and like activities.

Most existing buttock padding systems consist of rubber, plastic or gel pads fastened into shorts or worn as a unit. It is not convenient to change into or out of bulky padded shorts and/or transport and store them, especially without access to a changing facility. Also, diminished mobility may result from padding under the athlete's clothing in some circumstances. One example includes padding systems consisting of bulky neoprene rubber devices that are worn around the waist and legs, which may lack attachable pads and be susceptible to tearing during a fall, especially a sliding fall, on a hard surface.

However, one previous attempt includes U.S. Pat. No. 4,151,613 granted to Rhee teaches of a device for buttock and hip protection when skateboarding and is worn on the outside of one's clothing. Although an efficient design for skateboarding, the Rhee device is not designed for ease of storage, as the foam and resilient plastic portions are somewhat bulky. Further, if the Rhee device were not used for skateboarding, but rather for a sport done while sitting down, the center plastic resilient portion would interfere with sitting due to the curved shape. The curved shapes of the center and corner portions may also act like a snow, dirt, mud, or gravel scoop if used for skiing, snowboarding, or bicycling. The scooping effect during such a fall, due to the spoon-like shape of the plastic center portion and the corner portions, is exacerbated by the elastic cords which enable the scoop intake opening to enlarge. The scooping effect inhibits the slidability of the Rhee invention and therefore the person wearing it.

In addition, a large body of previous attempts of improved sitting inventions that naturally include some padding devices or other concepts to effectuate the isolation of the buttocks and a seating surface. The main improvement that relates to sports padding is a cushion that may be fastened on the outside of the wearer's clothing so that when the wearer sits down, the cushion is already affixed to the buttocks region. Further, these variations on what are essentially backless and legless chairs, besides a cushion or pillow affect, may include ease of transport and/or storage, temperature insulation, and water resistance (for sitting on wet surfaces). However, these sitting devices are designed for sitting, and are therefore rarely compatible, by design, with sporting or other activities that require a lot of physical activity and mobility because sitting is generally inherently inactive.

U.S. Pat. No. 5,652,957 granted to Willford et al., provides a bulky safety and comfort tool for roofers to be used when sitting on a slick roofing surface, especially high-pitched roofs. However, inherent and required in the Willford et al. device is a very high coefficient of friction (with respect to the seating surface or a roof) that, regardless of the density of the foam material used, would both tear and effectively consolidate total impact force into the initial impact moments if a sporting participant were to fall and/or slide on a hard surface with a reasonable amount of inertia in a sliding motion.

U.S. Pat. No. 6,175,959 granted to Somers teaches of a device that is designed for specific sports that primarily involve sitting in situations where temperature and moisture isolation is desirable. The Somers device, which involves a substantial portion of foam material and two layers of neoprene in the seat region, embraces and wraps around the inseam and each leg in varying degrees (depending on the embodiment), and may well add to the comfort level of ice fishermen or a hunter sitting and waiting in a cold and wet duck blind or tree perch. However, the Somers device is bulky due to the foam and neoprene and not designed for ease of transportation or stowage, but rather for sitting and to not unduly impede walking short distances. However, the embracing and wrap-around design to impart greater water resistance when seated also serves to impede twisting and pivoting movements, as are common in mogul skiing, aerial free-style skiing, and snowboarding. Additionally, the embracing and wrap-around design of the Somers device would likely cause irritation in the crotch and inner thigh region from friction when used in a high mobility activity.

Prior attempts at inflatable seating devices that are fastened about the buttocks and thighs of the user, which are also easy to transport and stow, are not common. However, U.S. Pat. No. 4,923,247 granted to Malmstrom teaches an inflatable seat cushion with a waist belt and a right and left leg strap. The device taught in Malmstrom is designed to provide a cushion for the user to sit on during outdoor sporting events with extremely limited movement in mind, such as standing up, sitting down, and ambulatory movement of short distances, as the Malmstrom device is designed to be deflated prior to transport to and from another outdoor sitting spectator event. Further, the air bladder of the Malmstrom device is designed to remain generally flat, even presumably when the legs of the wearer are constantly moving in ambulatory actions, and therefore is unsuitable for sporting or other activities that require high mobility.

U.S. Pat. No. 5,003,634 granted to Brinkman provides a convenient pouch and water resistant seating surface which retracts (into the pouch) and is designed to keep the user's clothing and person from getting wet when sitting on a wet surface. Likewise, the Brinkman device would severely inhibit movement, comfort, performance and likely tear or rip when used in an activity that requires mobility due to the flat sheet formation of the non-padded surface as well as leg straps which are designed to keep the sheet in place for a standard sitting position. The Brinkman device is designed to be folded away when the user is done sitting. For example, if the user wore the Brinkman device when skiing and fell, it is likely that the Brinkman device would either tear or act as a snow scoop (especially between the legs and below the inseam) during the fall and would retain a layer of snow and moisture between the sheet and the person, likely ensuring the user's buttocks, besides not being cushioned, would become sore and wet.

Thus, there is a need for a removable and retractable sport padding system that effectively, or at least partially, isolate impacts, is easy to put on, is convenient enough to make its use a seamless part of any sport, while at the same time is easy to remove, and discretely stow so as not to interfere with activities before and after the events.

SUMMARY OF THE INVENTION

The invention relates to safety and personal protective equipment for use during physical activities such as snowboarding, skateboarding, skating or other activities that may involve falls on hard surfaces or several smaller impacts. In particular, the invention relates to inflatable air bladder padding and sleeve, and in some embodiments, removable additional padding and braces that can be worn over clothes and that can be stowed in an integral waist pack. The invention protects the buttocks, lower back and spine, tailbone, and hips when properly fastened around the waist and legs. The addition of exterior attachments to the padding system helps to protect the padding system from tearing during a fall and assists the user to slide along a hard surface after a fall. When the leg straps, inflatable air bladder, and sleeve are retracted into the waist pack, the invention functions and looks like a "typical" waist pack, allowing the padding system to be carried conveniently and discretely.

The padding system of the present invention incorporates sufficient amounts of padding in order to decrease the minor traumas of the predictable impacts associated with the learning, training, participating, and competing in certain activities and sports. It is intended that this device can be used to prevent or minimize at least minor injuries and preferably more serious injuries. An embodiment of the present invention includes a removable back brace for further safety and protection. Another embodiment of the present invention is designed to allow the relevant portion of the padding system to be pulled down when the sleeve is fastened to the legs in order that the coccyx of the user is protected.

It is an object of the present invention to provide an effective padding system that can be worn outside one's clothes and is easily and quickly put on, configured for use, reconfigured for stowage, as well as removed. Further, the present invention preferably provides a padding system that does not hamper the user's immediate performance or cause a large inconvenience and waste of preparation time. It is further intended that the duration of the user's optimal performance may be increased by reducing pain, thus increasing comfort and concentration of the user. The ability of the present invention in concert with existing padded shorts and other undergarment padding systems is yet another object of the present invention.

A further object of the invention is to provide at least one water resistant chamber for items stored within the waist pack of the invention, including a water resistant separation from a retracted and moisture-laden air bladder and sleeve.

The inflatable air bladder and/or sleeve of the present invention is designed to conform to the user's shape. A first embodiment conforms to the shape of the user's figure by employing a semi-bifurcated air bladder shape. A second embodiment conforms to the shape of the user's figure by employing a biased air bladder. A third embodiment conforms to the shape of the user's figure by employing a biased sleeve. Further, a fourth embodiment conforms to the shape of the user's figure by employing both a biased air bladder and a biased sleeve. In yet another embodiment, the air bladder, air hose and/or pump are removable, and if need be, repairable or replaceable.

These and other features, aspects, and advantages of the present invention will become better understood with regard to the following description, appended claims, and accompanying drawings.

DETAILED DESCRIPTION

The invention is a retractable sport padding system. The invention is designed to effectively, or at least partially, isolate impacts, is easy to put on, and is convenient enough to make its use a seamless part of any sport, while at the same time is easy to remove, and discretely stow so as not to interfere with other activities before and after the sporting events.

Figure 1:
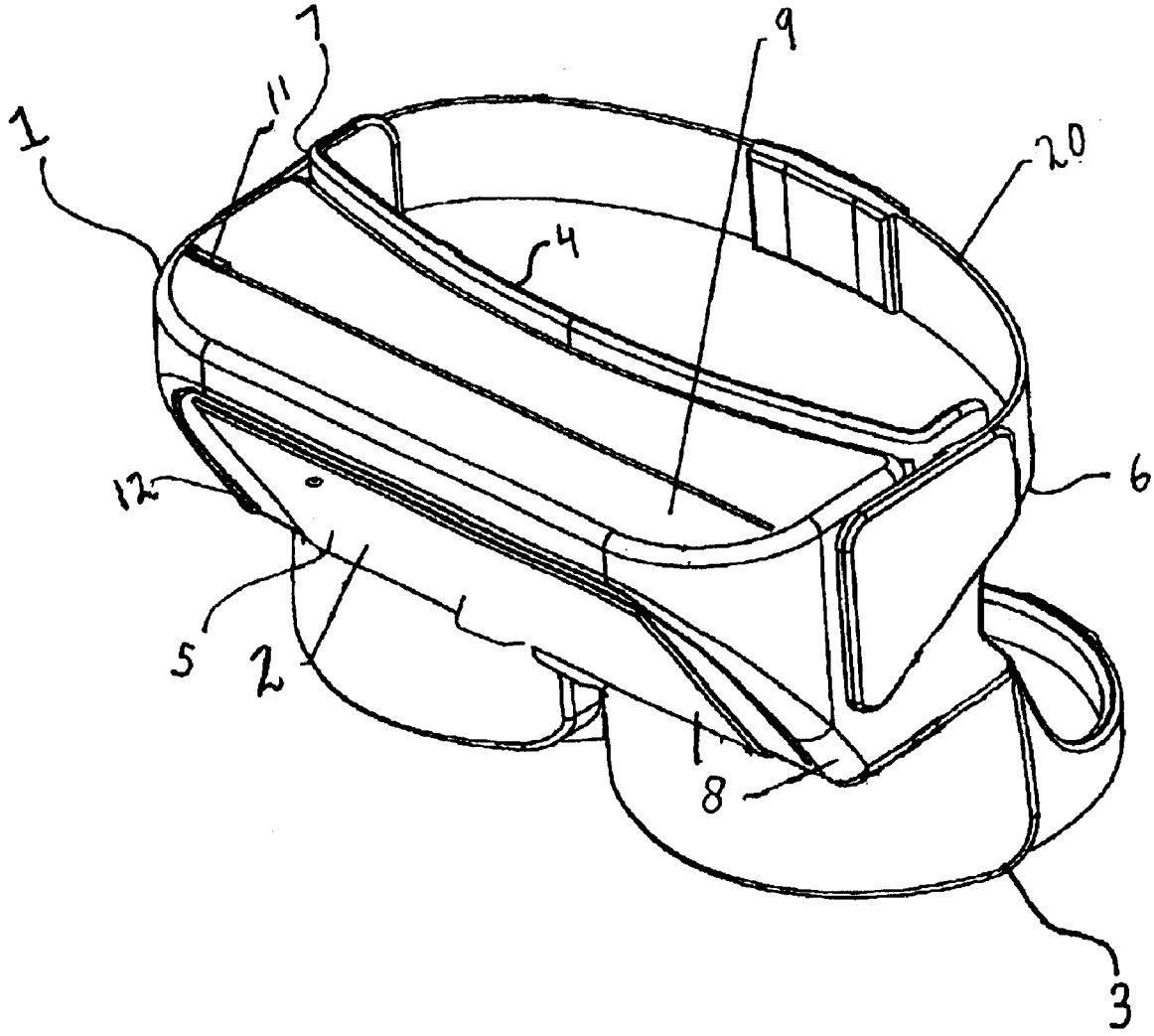
FIG. 1 is a perspective view of an embodiment of the invention depicting the waist pack, waist belt, back brace, right and left leg straps and hip guards as well as the air bladder and sleeve deployed.

Referring first to FIG. 1, the retractable sport padding device 1 has a sport pack housing 2 that has a sleeve 3, a front portion 4, a back portion 5, a right side portion 6, a left side portion 7, a bottom portion 8, a top portion 9, an interior portion, and an exterior portion. The back portion 5 is a planar surface angled downwards from the top portion 9 to the bottom portion 8 so that the top portion and the back portion join at an acute angle. The exterior portion, designed to slide on surfaces, is made of water resistant nylon and may incorporate hardened materials to promote slideability. The water resistant nylon has a first side and a second side. The first side is generally smooth, may incorporate the hardened materials, and faces the housing exterior while the second side faces the housing interior. The housing has a first fastener 11 in a first fastener zone and a second fastener 12 in a second fastener zone. The first fastener zone spans the right side portion, the back portion, and the left side portion. The second fastener zone is on the bottom portion. The first fastener 11 and the second fastener 12 open and close to seal and reseal, repelling moisture when closed and resealably expose the interior portion when open. The housing is designed to conform to the dorsal waist portion of a person.

A sleeve 3 is connected to the bottom portion 8 of the housing. The sleeve retractably extends from the bottom portion of the housing through the second fastener 12. The sleeve is made of nylon and designed to slide on surfaces and is made of water resistant nylon that may incorporate hardened materials to promote slideability. The nylon of the sleeve has a first side and a second side. The first side of the sleeve nylon is generally smooth, including the hardened materials, and is oriented to face the housing exterior while the second side is oriented to face the housing interior. The sleeve has an inside portion 40 and outside portion. The air bladder removably resides in the sleeve.

Figure 2:
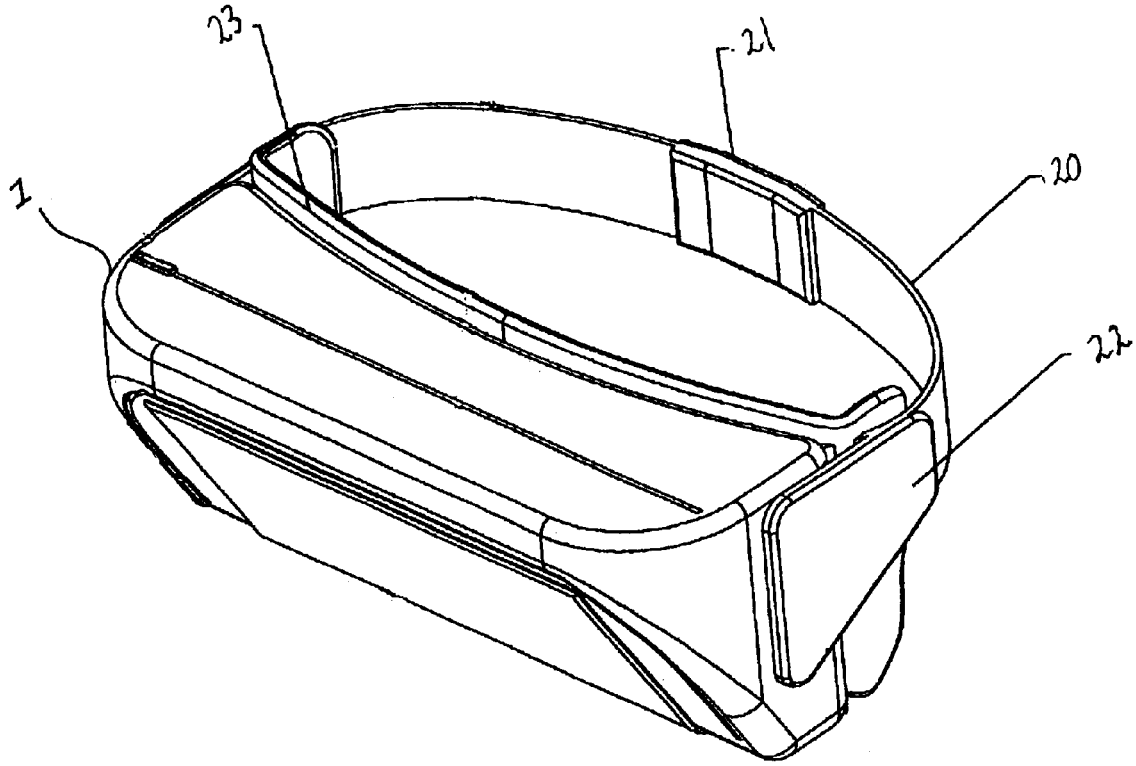
FIG. 2 is a perspective view of an embodiment of the invention depicting the waist pack with the air bladder and sleeve stowed.

Referring now to FIG. 2, a waist belt 20, connected to the housing 1, is designed to semi-permanently fasten 21 about the waist of a person. The waist belt has a right member connected to and proceeding from the right side portion of the housing and a left member connected to and proceeding from the left side portion of the housing. The right member and the left member both have a hip guard 22 that protects the hip areas of a person.

A back brace member 23 is semi-permanently fastened by a hook and pile fastener to the waist belt in the general area of the back portion 5 of the housing 1. The back brace is designed to support a person's lower back and prohibit lower back injury by limiting the amount of dorsal anterior to posterior range of motion of the lower back. Functionally, the back brace prevents stress by not allowing the lower back to become a fulcrum at the waist and bend backwards.

Figure 3:
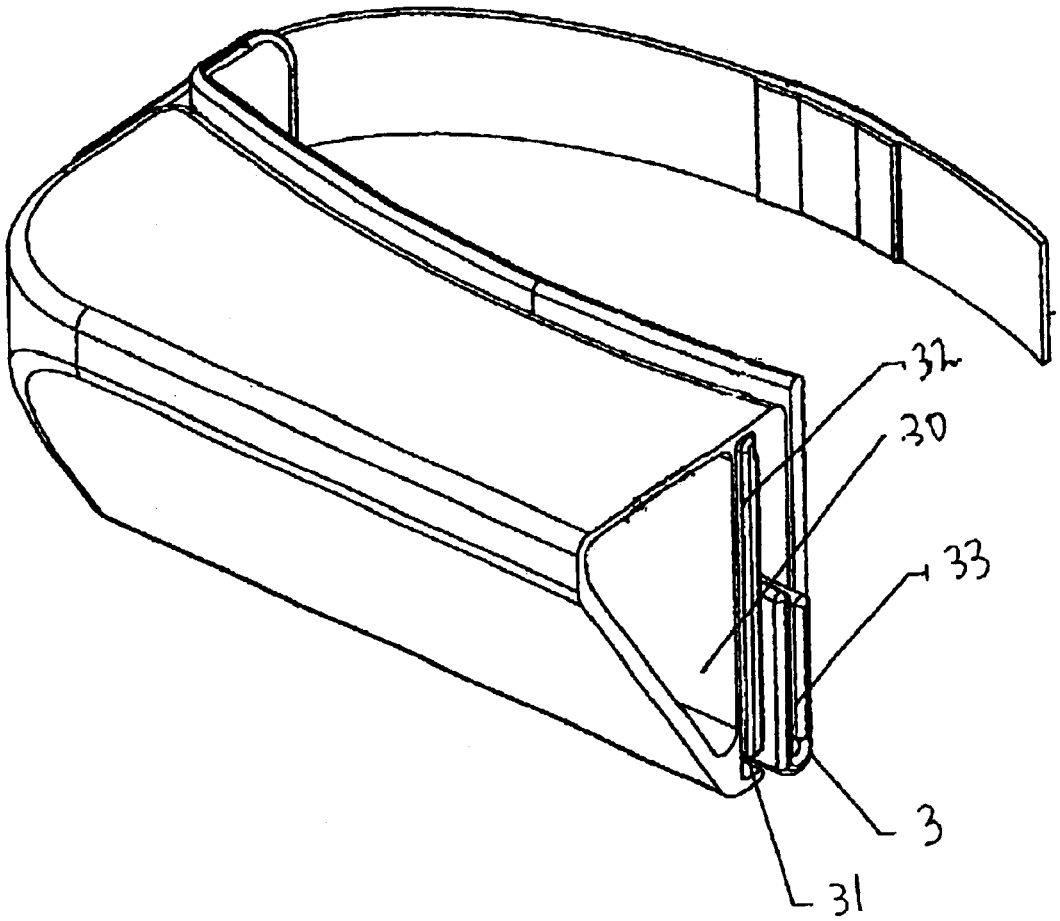
FIG. 3 is a cut away view of an embodiment of the invention depicting the air bladder and sleeve stowed in a housing chamber. The chambers of the housing are easily seen as well as the first fastener and second fastener zones.

Referring now to FIG. 3, the interior portion of the housing forms at least one chamber, preferably a plurality of chambers or sub-chambers 30 and 31. The chambers are divided either by a water-resistant material or a nylon mesh 32. One of the chambers 31 is used for storage of the sleeve and air bladder when the sleeve and air bladder is not in use. The other chamber 30 may be used for storage of the air hose and pump for inflating the air bladder as well as for personal items.

Upon deflation, the air bladder 33 and the sleeve 3 retract into one of the chambers either by folding or by rolling through the second fastener zone. In certain embodiments, the biased air bladder and/or the biased sleeve are designed to rollably retract into the housing in the same direction as the bias upon deflation. In another embodiment, the biased air bladder and/or the biased sleeve automatically retract into one of the chambers upon deflation.

Figure 4:
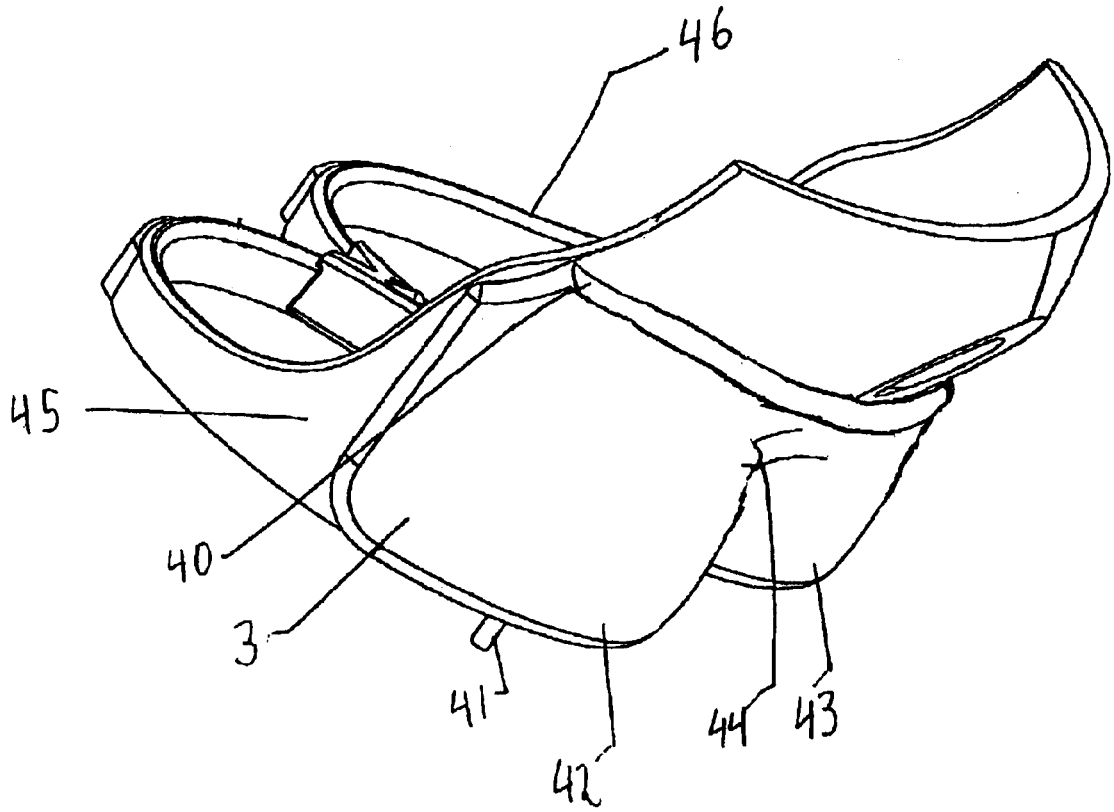
FIG. 4 is a perspective view of a depiction of the air bladder, air hose, pump, sleeve, and right and left leg straps with the waist pack removed.

Referring now to FIG. 4, the air bladder 33 removably resides in the sleeve 3 inside portion 40. The air bladder has an air hose 41 and pump that are designed to be removably stored in one of the chambers. The air bladder has a semi-bifurcated shape in a generally inverted "Y" shape. A first bifurcation 42 is designed to extend down a first leg of a person and a second bifurcation 43 is designed to extend down a second leg of a person. The first bifurcation and the second bifurcation may meet in an arcuate apex 44 or in an angular apex.

The sleeve has a right leg strap 45 with two members that are designed to releasably engage about the user's right leg as well as a left leg strap 46 with two members that are designed to releasably engage about the user's left leg. Collectively, the right and left leg straps, when engaged, pull down on the housing to protect the coccyx of the wearer.

Figure 5:
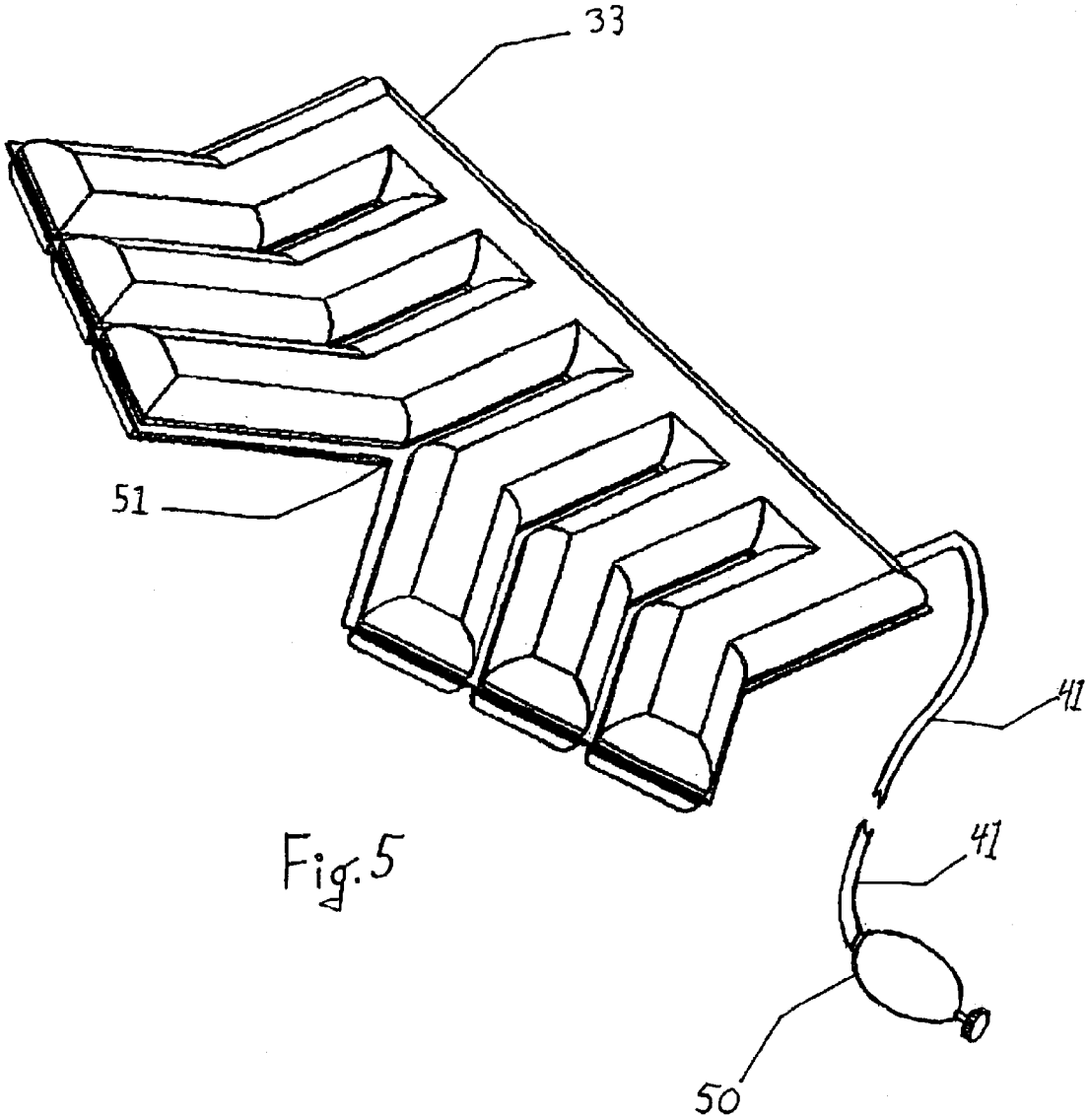
FIG. 5 is a perspective and partial view of a depiction of the air bladder and air hose.

Referring now to FIG. 5, the air bladder 33 has an air hose 41 and pump 50 that are designed to be removably stored in one of the chambers. The air hose 41 and pump 50 retractably extend to the ventral portion of a person where, upon activation, the pump 50 adjustably inflates as well as deflates the air bladder 33. The first bifurcation and the second bifurcation may meet in an arcuate apex or in an angular apex 51. In certain embodiments, the air bladder and/or the sleeve are arcuately biased to conform to the dorsal portions of a user when the air bladder is inflated.

The previously described versions of the present invention have many advantages, including the durable, retractable air bladder and sleeve that allows for increased range of motion as well as the ability to be discretely stowed. Thus, the problems that may be associated with some previous attempts at sports padding that have not been able to offer convenience, safety, variable configurations, or comfort are solved with this invention.

Another advantage of the invention is the case of transport and storage of padding, including an air bladder, for use in sports or other activities requiring high mobility.

Yet another advantage of the invention includes the various configurations of contoured biased padding available, including the inflatable air bladder, the hip padding and the removable back brace.

A further advantage of the invention is the durability of the waist pack and cushions for use in sports and other activities that demand high physical mobility and/or are prone to various impact associated stresses.

Another advantage is the invention is the freedom and range of movement imparted to the user by virtue of the design.

Yet another advantage of this invention is the potential for the padding to be discretely stored in the waist pack. This advantage allows the user to enter a ski lodge during a break from skiing or snow boarding without wearing a set of pads that makes them look broad in the beam if under the clothes, a diaper if the padding is worn over the clothes or not look like a beginner. "snow bunny".

Still a further advantage of the invention is that the air bladder can be removed, replaced or repaired.

Another advantage of the invention is the slideable design of the housing.

It is important to note, however, that the invention does not require that all these advantages need be incorporated into every embodiment of the invention.

Although the present invention has been described in considerable detail with reference to certain preferred embodiments thereof, other embodiments or versions are possible. For example, various hooks and fasteners may be attached to the external portion and/or the internal portion of the housing or a pump not connected to an air hose. Therefore, the spirit and scope of the appended claims should not be limited to the description of the preferred embodiments contained herein.

I claim:

1. A retractable sport padding device, comprising:

a. a waist pack housing designed to conform to the dorsal waist portion of a person, said housing with a sleeve, a front portion, a back portion, a right side portion, a left side portion, a bottom portion, a top portion, an interior portion, and an exterior portion, said interior portion forming a chamber, said exterior portion designed to slide on surfaces, said housing having a first fastener in a first fastener zone and a second fastener in a second fastener zone, said first fastener zone residing on said right side portion, said front portion, and said left side portion, and said second fastener zone residing on said bottom portion, said first fastener and said second fastener designed to resealably expose said interior portion and repel moisture when sealed;

b. said sleeve with an inside portion and an outside portion and said sleeve designed to retractably extend from said bottom portion, said sleeve designed to slide on surfaces, said sleeve having a right leg strap and a left leg strap, said right leg strap having two members and designed to releasably engage about the user's right leg and said left leg strap having two members and designed to releasably engage about the user's left leg;

c. a waist belt connected to said housing and designed to semi-permanently fasten about the waist of a person, said waist belt having a right member proceeding from said right side portion of said housing and said waist belt having a left member proceeding from said left side portion of said housing;

d. a back brace member semi-permanently fastened to said waist belt in the general area of the back portion of said housing, said back brace designed to support the back of a person and designed to assist in protecting the lower back of a person from injury by limiting the amount of dorsal anterior to posterior range of motion of the lower back;

e. an air bladder designed to removably reside in said sleeve inside portion, said air bladder having an air hose and pump, said air hose and pump designed to be removably stored within said chamber and further designed to retractably extend to the ventral portion of a user where, upon activation, said pump is designed to adjustably inflate as well as deflate said air bladder, and said air bladder having a semi-bifurcated shape, wherein a first bifurcation is designed to extend down a first leg of a person and a second bifurcation is designed to extend down a second leg of a person, said first bifurcation and said second bifurcation meeting in an apex, and said air bladder further designed to retractably extend with said sleeve from said housing;

f. a first leg strap and fastener connected to said sleeve and a second leg strap and fastener connected to said sleeve, said first leg strap and fastener designed to releasably engage a first leg of a person and said second leg strap and fastener designed to releasably engage a second leg of a person.

2. The retractable sport padding device of claim 1, wherein said air bladder apex is an apex shape selected from the group consisting of an arcuate apex and an angular apex.

3. The retractable sport padding device of claim 1, wherein said back portion comprises a planar surface angled downwards from said top portion to said bottom portion such that said top portion and said back portion join at an acute angle.

4. The retractable sport padding device of claim 1, wherein said housing comprises water resistant nylon, said nylon having a first side and a second side, said first side generally smooth and facing said housing exterior, said second side facing said housing interior.

5. The retractable sport padding device of claim 1, wherein said chamber further comprises a plurality of sub-chambers.

6. The retractable sport padding device of claim 5, wherein said air bladder and said sleeve retract into one of said sub-chambers.

7. The retractable sport padding device of claim 6, wherein said sub-chambers are divided by a moisture resistant material.

8. The retractable sport padding device of claim 6, wherein said sub-chambers are divided by a nylon mesh.

9. The retractable sport padding device of claim 6, wherein said air bladder and said sleeve foldably retract into said sub-chamber.

10. The retractable sport padding device of claim 6, wherein said air bladder and said sleeve rollably retract into said sub-chamber.

11. The retractable sport padding device of claim 10, wherein said rollably retractable air bladder is biased to conform to the dorsal portions of a user when inflated.

12. The retractable sport padding device of claim 10, wherein said rollably retractable sleeve is biased to conform to the dorsal portions of a user when said air bladder is inflated and inserted into said sleeve.

13. The retractable sport padding device of claim 1, wherein said housing further comprises portions of hardened material on said outside portion designed to promote slideability of said housing.

14. The retractable sport padding device of claim 1, wherein said sleeve further comprises portions of hardened material on said outside portion designed to promote slideability of said sleeve.

15. A retractable sport padding device, comprising:

a. a waist pack housing designed to conform to the dorsal waist portion of a person, said housing with a sleeve, a front portion, a back portion, a right side portion, a left side portion, a bottom portion, a top portion, an interior portion, and an exterior portion, said interior portion forming a plurality of moisture resistant chambers, said exterior portion designed to slide on surfaces and made of water resistant nylon and hardened materials to promote slideability, said water resistant nylon having a first side and a second side, said first side generally smooth incorporating said hardened materials and facing said housing exterior, said second side facing said housing interior, said housing having a first fastener in a first fastener zone and a second fastener in a second fastener zone, said first fastener zone residing on said right side portion, said front portion, and said left side portion, and said second fastener zone residing on said bottom portion, said first fastener and said second fastener designed to resealably expose said interior portion and repel moisture when sealed;

b. said sleeve with an inside portion and an outside portion, said sleeve designed to retractably extend from said bottom portion through said second fastener zone, said sleeve designed to slide on surfaces and said sleeve made of water resistant nylon and hardened materials to promote slideability, said nylon having a first side and a second side, said first side generally smooth with said hardened materials and facing said housing exterior, said second side facing said housing interior, said right leg strap having two members designed to releasably engage about the user's right leg and said left leg strap having two members designed to releasably engage about the user's left leg, and collectively the right and left leg straps are further designed to pull said housing down to protect the coccyx of the wearer;

c. a waist belt connected to said housing and designed to semi-permanently fasten about the waist of a person, said waist belt having a right member proceeding from said right side portion of said housing and said waist belt having a left member proceeding from said left side portion of said housing, said right member and said left member each having a hip guard designed to protect the hip area of a person;

d. a back brace member semi-permanently fastened to said waist belt in the general area of the back portion of said housing, said back brace designed to support the back of a person and designed to assist in protecting the lower back of a person from injury by limiting the amount of dorsal anterior to posterior range of motion of the lower back;

e. an air bladder designed to removably reside in said sleeve inside portion, said air bladder having an air hose and pump, said air hose and pump designed to be removably stored within one of said chambers and further designed to retractably extend to the ventral portion of a user where, upon activation, said pump is designed to adjustably inflate as well as deflate said air bladder, and said air bladder having a semi-bifurcated shape in a generally inverted "Y" shape, wherein a first bifurcation is designed to extend down a first leg of a person and a second bifurcation is designed to extend down a second leg of a person, said first bifurcation and said second bifurcation meeting in an apex, and said air bladder further designed to retractably extend with said sleeve from said housing through said second fastener zone and into one of said chambers;

f. a first leg strap and fastener connected to said sleeve and a second leg strap and fastener connected to said sleeve, said first leg strap and fastener designed to releasably engage a first leg of a person and said second leg strap and fastener designed to releasably engage a second leg of a person.

16. The retractable sport padding device of claim 15, wherein said air bladder apex is an apex shape selected from the group consisting of an arcuate apex and an angular apex.

17. The retractable sport padding device of claim 15, wherein said back portion comprises a planar surface angled downwards from said top portion to said bottom portion such that said top portion and said back portion join at an acute angle.

18. The retractable sport padding device of claim 15, wherein said chambers are divided by a nylon mesh.

19. The retractable sport padding device of claim 15, wherein said air bladder and said sleeve are designed to retract into one of said chambers comprising one of the group consisting of foldably retracting and rollably retracting.

20. The retractable sport padding device of claim 15, further comprising said air bladder and said sleeve being designed to automatically retract into said housing upon deflation.

21. The retractable sport padding device of claim 15, wherein said retractable air bladder is biased to conform to the dorsal portions of a user when inflated.

22. The retractable sport padding device of claim 15, wherein said air bladder and said sleeve are biased to conform to the dorsal portions of a user when inflated.

23. The retractable sport padding device of claim 15, wherein said rollably retractable sleeve is arcuately biased to conform to the dorsal portions of a user when said air bladder is inflated and inserted into said sleeve.

24. A retractable sport padding device, comprising:

a. a waist pack housing, said housing having a sleeve, a front portion, a back portion, a right side portion, a left side portion, a bottom portion, a top portion, an interior portion, and an exterior portion, said interior portion forming a chamber, said waist pack housing designed to slide on surfaces;

b. said sleeve with an inside portion and an outside portion and said sleeve designed to retractably extend from said waist pack housing, said sleeve designed to slide on surfaces, said sleeve having a right leg strap and a left leg strap, said right leg strap designed to releasably engage about the user's right leg and said left leg strap designed to releasably engage about the user's left leg;

c. a waist belt connected to said housing and designed to semi-permanently fasten about the waist of a person;

d. an air bladder designed to removably reside in said sleeve inside portion, said air bladder having an air hose and pump, said air hose and pump designed to be removably stored within said chamber and further designed to retractably extend, said pump designed to adjustably inflate as well as deflate said air bladder, and said air bladder having a semi-bifurcated shape, wherein a first bifurcation is designed to extend down a first leg of a person and a second bifurcation is designed to extend down a second leg of a person, said first bifurcation and said second bifurcation meeting in an apex, and said air bladder further designed to retractably extend with said sleeve from said housing;

e. a first leg strap and fastener connected to said sleeve and a second leg strap and fastener connected to said sleeve, said first leg strap and fastener designed to releasably engage a first leg of a person and said second leg strap and fastener designed to releasably engage a second leg of a person.

25. A retractable sport padding device, comprising:

a. a waist pack housing designed to conform to the dorsal waist portion of a person, said housing with a sleeve, a front portion, a back portion, a right side portion, a left side portion, a bottom portion, a top portion, an interior portion, and an exterior portion, said back portion comprises a planar surface angled downwards from said top portion to said bottom portion such that said top portion and said back portion join at acute angle, said interior portion forming a plurality of chambers, said exterior portion designed to slide on surfaces and made of moisture resistant nylon and hardened materials to promote slideability, said water resistant nylon having a first side and a second side, said first side generally smooth incorporating said hardened materials and facing said housing exterior, said second side facing said housing interior, said housing having a first fastener in a first fastener zone and a second fastener in a second fastener zone, said first fastener zone residing on said right side portion, said front portion, and said left side portion, and said second fastener zone residing on said bottom portion, said first fastener and said second fastener designed to resealably exposing said interior portion and repel moisture when sealed;

b. said sleeve with an inside portion and an outside portion, said sleeve deigned to retractably extend from said bottom portion through said second fastener zone, said sleeve designed to slide on surfaces and said sleeve made of water resistant nylon and hardened materials to promote slideability, said nylon having a first side and a second side, said first side generally smooth with said hardened materials and facing said housing exterior, said second side facing said housing interior, said right leg strap having two members designed to releasably engage about the user's right leg and said left leg strap having two members designed to releasably engage about the user's left leg, and collectively the right and left leg straps are further designed to pull said housing down to protect the coccyx of the wearer;

c. a waist belt connected to said housing and designed to semi-permanently fasten about the waist of a person, said waist belt having a right member connected to and proceeding from said right side portion of said housing and said waist belt having a left member connected to and proceeding from said left side portion of said housing, said right member and said left member each having a hip guard designed to protect the hip area of a person;

d. a back brace member semi-permanently fastened to said waist belt in the general area of the back portion of said housing, said back brace designed to support the back of a person and designed to assist in protecting the lower back of a person from injury by limiting the amount of dorsal anterior to posterior range of motion of the lower back;

e. an air bladder designed to removably reside in said sleeve inside portion, said air bladder having an air hose and pump, said air hose and pump designed to be removably stored within one of said chambers and further designed to retractably extend to the ventral portion of a user where, upon activation, said pump is designed to adjustably inflate as well as deflate said air bladder, and said air bladder having a semi-bifurcated shape in a generally inverted "Y" shape, wherein a first bifurcation is designed to extend down a first leg of a person and a second bifurcation is designed to extend down a second leg of a person, said first bifurcation and said second bifurcation meeting in an apex, and said air bladder further designed to retractably extend with said sleeve from said housing through said second fastener zone and into one of said chambers;

f. a first leg strap and fastener connected to said sleeve and a second leg strap and fastener connected to said sleeve, said first leg strap and fastener designed to releasably engage a first leg of a person and said second leg strap and fastener designed to releasably engage a second leg of a person.

26. The retractable sport padding device of claim 24, wherein said air bladder apex is an apex shape selected from the group consisting of an arcuate apex and an angular apex.

27. The retractable sport padding device of claim 24, wherein said chambers are divided by a nylon mesh.

28. The retractable sport padding device of claim 24, wherein said air bladder and said sleeve are designed to retract into one of said chambers comprising one of the group consisting of foldably retracting and rollably retracting.

29. The retractable sport padding device of claim 24, further comprising said biased air bladder and said biased sleeve being designed to automatically retract into said housing upon deflation.

30. The retractable sport padding device of claim 24, wherein said air bladder and said sleeve are biased to conform to the dorsal portions of a user when inflated.

31. The retractably sport padding device of claim 30, wherein said biased air bladder and said biased sleeve are designed to rollably retract into said housing in the same direction as said bias upon deflation.

* * * * *